US007806721B2

(12) United States Patent
Herndon et al.

(10) Patent No.: US 7,806,721 B2
(45) Date of Patent: Oct. 5, 2010

(54) PATCH PANEL MODULAR JACK ASSEMBLY

(75) Inventors: Stephen Scott Herndon, Danville, VA (US); Robert Jeffrey Burwell, Staley, NC (US); Joseph Edward Geniac, Greensboro, NC (US); Christine Anne Dooley, Lewisville, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/167,031

(22) Filed: Jul. 2, 2008

(65) Prior Publication Data

US 2009/0034226 A1 Feb. 5, 2009

Related U.S. Application Data

(60) Provisional application No. 60/963,036, filed on Aug. 2, 2007.

(51) Int. Cl.
*H01R 13/60* (2006.01)

(52) U.S. Cl. ..... 439/540.1

(58) Field of Classification Search ..... 439/540.1, 439/676; 385/135, 55; 361/822, 825
See application file for complete search history.

(56) References Cited

U.S. PATENT DOCUMENTS

| | | | | |
|---|---|---|---|---|
| 5,096,439 | A | 3/1992 | Arnett | |
| 7,361,063 | B2 * | 4/2008 | Mullin et al. | 439/676 |
| 2004/0209515 | A1 * | 10/2004 | Caveney et al. | 439/540.1 |
| 2004/0229501 | A1 * | 11/2004 | Caveney et al. | 439/540.1 |
| 2005/0186844 | A1 | 8/2005 | Hammond, Jr. et al. | |
| 2005/0215112 | A1 * | 9/2005 | Barker et al. | 439/540.1 |
| 2006/0154513 | A1 * | 7/2006 | Barker et al. | 439/450 |
| 2008/0090461 | A1 * | 4/2008 | Pepe et al. | 439/649 |
| 2008/0096438 | A1 * | 4/2008 | Clark et al. | 439/713 |
| 2008/0146079 | A1 * | 6/2008 | Spisany et al. | 439/540.1 |

FOREIGN PATENT DOCUMENTS

| | | |
|---|---|---|
| EP | 1 478 056 | 11/2004 |
| WO | WO 97/44863 | 11/1997 |

OTHER PUBLICATIONS

Information Sheet on Panduit Part No. CPPA48HDWBLY, downloaded from website http://www.panduit.com/Support/Search/index.htm?Nu=P_RollupKey&Text=CPPA48HDWBLY&Filter=All on Jul. 2, 2008, (1) page.

Leviton Part Nos. 5G270-D48, 69270-D48 and 6910G-D48 Information Sheet with Component Specifications, downloaded from website www.levitonvoicedata.com on Jul. 2, 2008, (2) pages.

Information Sheet for Hubbell Part No. PXJ648DKE1U, downloaded from website www.hubbell-premise.com on Jul. 2, 2008, (12) pages.

* cited by examiner

*Primary Examiner*—Edwin A. Leon
*Assistant Examiner*—Vanessa Girardi

(57) ABSTRACT

A module assembly includes an interface module including a housing having a plurality of jack cavities and associated jack latch openings. The housing is configured to be mated with a patch panel. The module assembly also includes a plurality of modular jacks that are directly inserted into corresponding jack cavities. Each modular jack includes a single latch arm that engages the jack latch opening to retain the modular jack in the jack cavity. Optionally, each modular jack may include a top surface and a bottom surface, wherein the latch arm extends from the top surface and wherein the bottom surface is planar. The bottom surface may rest flush with a bottom wall of the jack cavity.

19 Claims, 4 Drawing Sheets

PATCH PANEL MODULAR JACK ASSEMBLY

CROSS REFERENCE TO RELATED APPLICATIONS

This application claims the benefit of U.S. Provisional Application No. 60/963,036 filed Aug. 2, 2007, titled "INTERFACE MODULE AND INSERTABLE JACK", the subject matter of which is herein incorporated by reference in its entirety.

BACKGROUND OF THE INVENTION

The subject matter herein relates generally to interface modules that interface network components and, more particularly, to an interface module and insertable jack for use with patch panels.

Electronic components are typically connected to an electronic network using patch panels that allow connections between components in the network. In some applications, an interface module may be retained in the patch panel, or any number of other network structures that interconnect two or more separate network components. The interface module provides for easier mounting of a high number of modular jacks into a single opening in a panel or other network structure. In a typical application, the module is mounted to the panel and the modular jacks are then loaded into the module.

Existing modules allow a plurality of unshielded jacks to be loaded into each module. However, existing modules require jacks to be mounted into the module, and removed from the module, via the rear of the patch panel. Accordingly, each individual jack must be installed and/or removed from the rear side of the patch panel.

Additionally, current jacks are mounted into the module using latches on both the top surface and bottom surface of the jack. In current "tilt and latch" applications, the jack is installed by insertion of the jack into the module and tilted at an angle to seat the first latch. Then the jack is rotated causing the second latch to catch and lock. Since the jack must be angled to engage both latches, extra space or clearance height is required to install and remove the jacks. Also, current patch panel and module designs do not have the ability to have labeling and port designations to identify the connections in the patch panel.

Accordingly, a need remains for interface modules that are front loadable. A need remains for interface modules that may receive jacks therein and that may have the jacks removed therefrom in a tight clearance window. A need also remains for an interface module that allows for labeling the ports in the patch panel.

BRIEF DESCRIPTION OF THE INVENTION

In one embodiment, a module assembly is provided that includes an interface module including a housing having a plurality of jack cavities and associated jack latch openings. The housing is configured to be mated with a patch panel. The module assembly also includes a plurality of modular jacks that are directly inserted into corresponding jack cavities. Each modular jack includes a single latch arm that engages the jack latch opening to retain the modular jack in the jack cavity.

Optionally, each modular jack may include a top surface and a bottom surface, wherein the latch arm extends from the top surface and wherein the bottom surface is planar. Each jack cavity may include a top wall that has the jack latch opening and a bottom wall. Each modular jack may include a top surface having the latch arm and a bottom surface resting flush with the bottom wall. Optionally, the modular jacks may be inserted into the jack cavities either prior to or after the housing is mated with the patch panel. The housing may have a mating end and a loading end wherein the cavities have a longitudinal axis extending between the mating and loading ends with the modular jacks being insertable into the jack cavities in a direction parallel to the longitudinal axis. The jack cavities may be arranged in two vertically staged rows, wherein the interface module is configured to fit into a 1 U height requirement of the patch panel. Optionally, the jack cavities may be arranged in an upper row and a lower row that are separated by a wall of the housing, wherein the wall defines a top wall of the jack cavities in the lower row and a bottom wall of the jack cavities in the upper row. The wall may have a plurality of the jack latch openings, wherein the latch arms are sized to fit within the jack latch openings so that the modular jacks in the upper row rest flush with the wall of the housing.

In another embodiment, a module assembly is provided that includes an interface module adapted for front loading into a patch panel. The interface module includes a housing having at least one jack cavity configured to receive a modular jack therein. The housing has a faceplate on a front surface thereof, wherein the faceplate includes a rearward facing surface. The interface module also includes at least one jack latch opening configured to receive a latch arm of the modular jack, and a latch mechanism on the housing for latching the module into the panel. When the housing is loaded into the patch panel, the rearward facing surface of the faceplate is configured to engage a front of the patch panel and the latch mechanism is configured to engage a rear of the patch panel. Optionally, the latch mechanism may be releasably latched to the patch panel such that the housing may be pulled from the front of the patch panel when the latch mechanism is released. The latch mechanism may include a fixed latch on one side of the housing and a flexible latch on the opposite side of the housing, wherein the flexible latch is movable between a latched position and an unlatched position to lock and unlock the housing to the patch panel.

In a further embodiment, a module assembly is provided including an interface module having a housing that includes a front surface, a rear surface and a plurality of jack cavities extending between the front surface and the rear surface. The jack cavities have a top wall and a bottom wall and the jack cavities are configured to receive modular jacks therein. Each modular jack includes a latch arm with a hook end. The interface module also includes a plurality of primary openings in the front surface providing access to the jack cavities, and jack latch openings in the top wall of each jack cavity. The jack latch openings are configured to receive the hook end of the latch arm of the modular jack received within the jack cavity. The interface module includes a plurality of secondary openings that are aligned with corresponding primary openings and with corresponding jack latch openings. The secondary openings are configured to receive a tool therein for engaging and releasing the hook end of the modular jack from the jack latch opening.

DETAILED DESCRIPTION OF THE INVENTION

Figure 1:
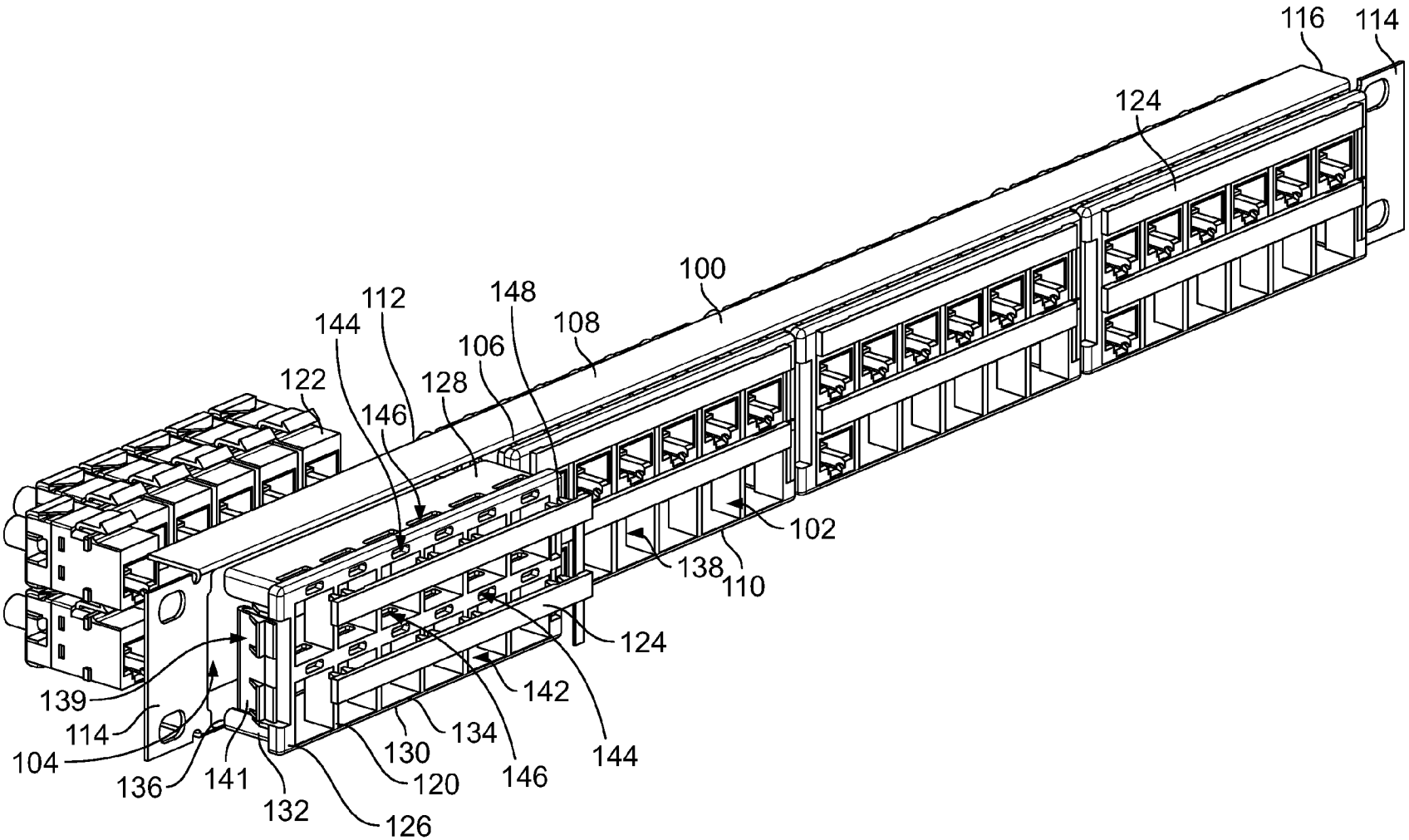
FIG. 1 shows an exploded front perspective view of a patch panel and exemplary interface modules.

FIG. 1 shows an exploded front perspective view of a patch panel 100 and an exemplary embodiment of module assemblies 102. The patch panel 100 includes a plurality of panel openings 104 in a front face 106 thereof. The module assemblies 102 are loaded into corresponding panel openings 104 and are securely coupled to the patch panel 100. In an exemplary embodiment, the module assemblies 102 are front loaded into the patch panel 100. In the illustrated embodiment, four module assemblies 102 are provided, however, any number of module assemblies 102 may be provided in alternative embodiments.

The patch panel 100 also includes a top 108, a bottom 110 and a rear 112. Rack mounting tabs 114 are provided at sides 116 of the patch panel 100 for mounting to a standard equipment rack (not shown) or other cabinet system. The patch panel 100 and rack mounting tabs 114 fit into 1 U height requirements.

Each module assembly 102 includes an interface module 120, a plurality of modular jacks 122 and panel labels 124. The interface module 120 includes a housing 126 having a top 128, a bottom 130, opposed sides 132, a mating end 134 and a loading end 136. The interface module 120 includes a plurality of jack cavities 138 that extend between the mating end 134 and the loading end 136. The modular jacks 122 are loaded into the jack cavities 138 through the loading ends 136. Mating connectors, such as modular plugs (not shown), are mated with the modular jacks 122 through the mating ends 134. In an exemplary embodiment, the jack cavities 138 are arranged in two rows that are vertically staged. Optionally, twelve jack cavities 138 may be provided in each interface module 120 and a total of forty-eight jack cavities 138 and modular jacks 122 are provided in each patch panel 100. The housing 126 is made of plastic and includes guidance and retention features for mating with the patch panel 100. For example, the housing 126 is configured to latch into the panel openings 104, or some other equipment opening, via a latching mechanism 139. In the illustrated embodiment, the latching mechanism 139 includes a fixed latch 140 (shown in FIG. 3) on one side 132 of the housing 126 and a flexible latch 141 on the opposite side 132 of the housing 126. The flexible latch 141 is deflectable to latch to the patch panel 100 when the interface module 120 is mated thereto.

The housing 126 includes a plurality of primary openings 142 in the mating end 134 of the housing 126 that provide access to the jack cavities 138. Each jack cavity 138 includes a corresponding primary opening 142. The housing 126 also includes a plurality of secondary openings 144 in the mating end 134 of the housing 126. The secondary openings 144 are elongated slots aligned vertically above corresponding primary openings 142. The secondary openings 144 may represent panel label openings that are configured to receive the panel label 124. The secondary openings 144 may represent tool openings configured to receive a tool for releasing the modular jacks 122 from the jack cavities 138, as will be described in further detail below. The housing 126 also includes a plurality of jack latch openings 146. Each jack cavity 138 includes a corresponding jack latch opening 146. The modular jacks 122 are configured to latch into the jack latch openings 146 to secure the modular jacks 122 within the jack cavities 138.

The panel labels 124 are coupled to the housing 126 and secured thereto using attachment features 148. The panel labels 124 provide port identification and other labeling such as to identify the particular jack cavity 138 with which the panel label 124 is associated. In an exemplary embodiment, the attachment features 148 include two flexible legs that flex towards each other when inserted into the secondary openings 144 and release once inside the secondary openings 144 to hold the panel label 124 to the housing 126. One skilled in the art would know of various alternate attachment features that would be suitable to attach the panel label 124 to the housing 126. In the illustrated embodiment, the panel labels 124 are elongated plate-type panel labels, wherein the panel labels 124 extend along at least two of the jack cavities 138. Optionally, the panel labels 124 may extend along all of the jack cavities 138 of the interface module 120. Each interface module 120 includes two panel labels 124, one for each row of jack cavities 138. In alternative embodiments, each jack cavity 138 may receive a separate panel label 124, such as an icon label, that fits generally vertically above the jack cavity 138. For example, six panel labels 124 may be aligned with one another in a row that correspond to each row of jack cavities 138.

Figure 2:
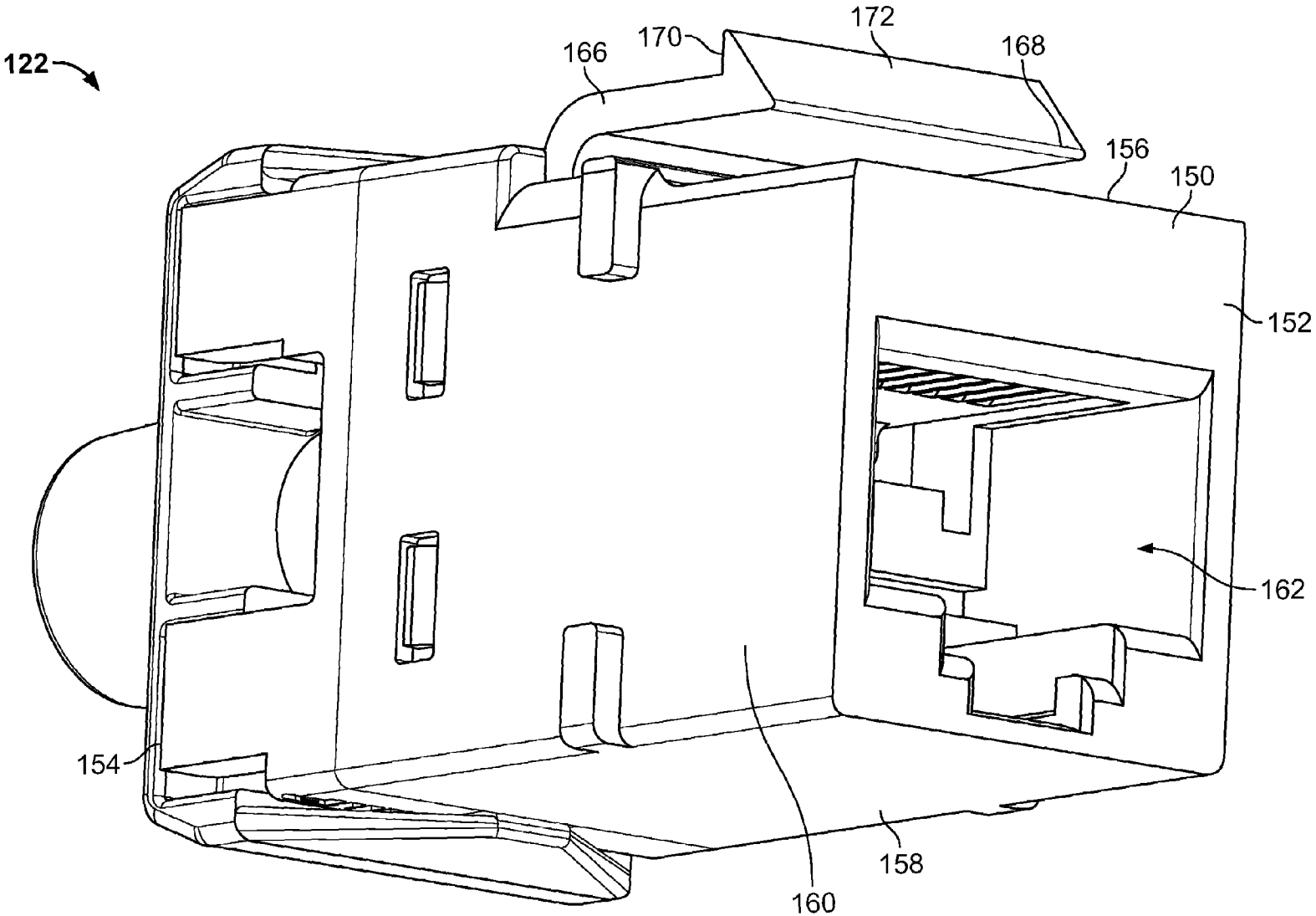
FIG. 2 shows a front perspective view of one of the modular jacks that is used with one of the interface modules shown in FIG. 1.

FIG. 2 shows a front perspective view of one of the modular jacks 122 that is used with one of the interface modules 120 (shown in FIG. 1). The modular jack 122 includes a housing 150 having a mating end 152 and a wire termination end 154. Optionally, the wire termination end 154 may include a cap, however, those skilled in the art would know of acceptable alternate wire termination end configurations. The modular jack 122 may be provided at the end of a cable (not shown) having individual wires (not shown) that are mated to corresponding contacts (not shown) within the modular jack 122 at the wire termination end 154.

The modular jack 122 also includes a top surface 156, a bottom surface 158 and side surfaces 160. A mating cavity 162 is provided at the mating end 152, and mating contacts (not shown) are located within the mating cavity 162 for mating engagement with the mating connector (not shown). A single latch arm 166 extends from the top surface 156. The latch arm 166 includes a hook end 168 having a catch surface 170 and a ramp surface 172. The catch surface 170 is rearward facing and the ramp surface 172 is forward facing. The bottom surface 158 is generally flat or planar.

Figure 3:
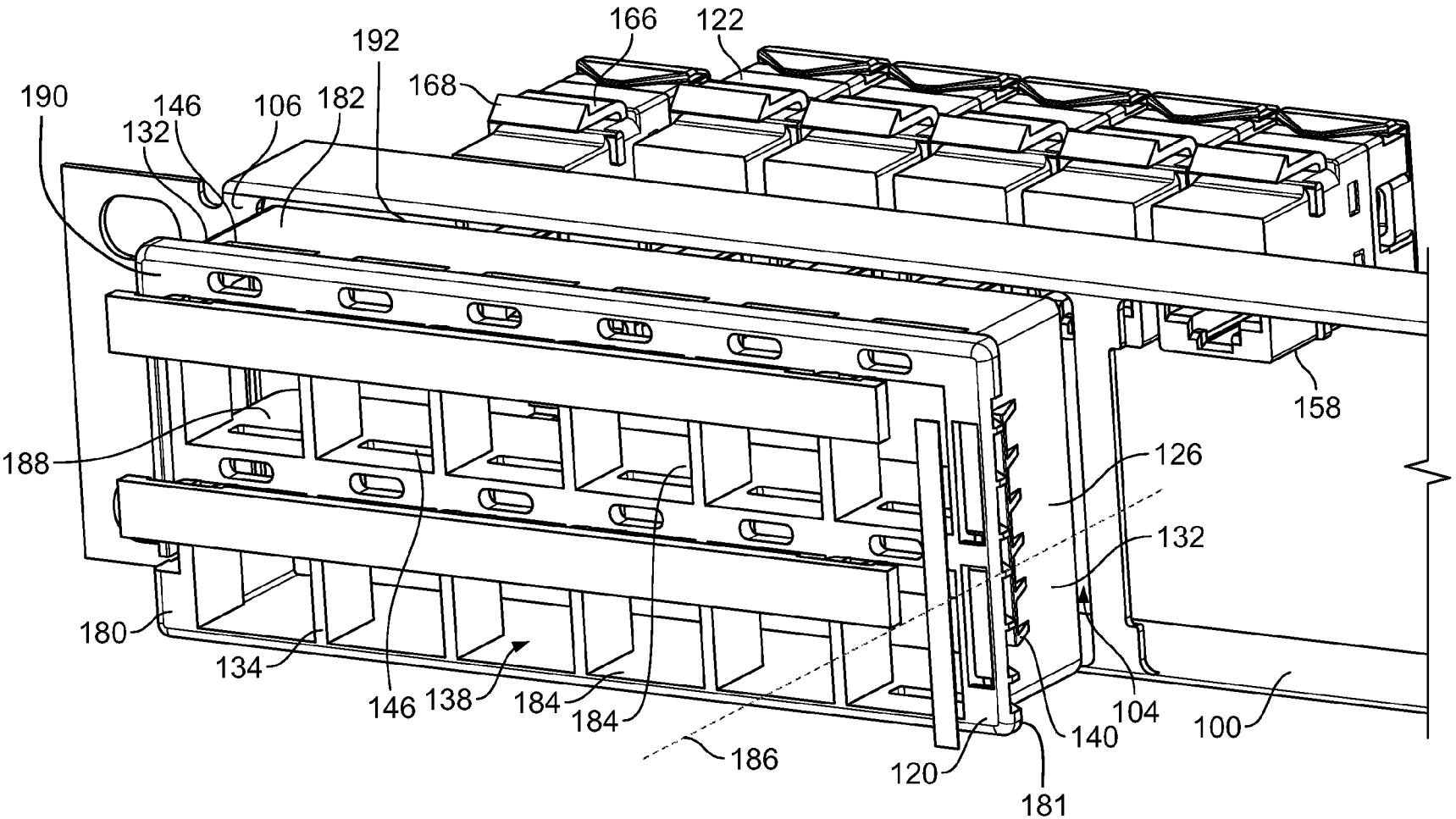
FIG. 3 shows a front perspective view of a portion of the patch panel and one of the interface modules.

FIG. 3 shows a front perspective view of a portion of the patch panel 100 and one of the interface modules 120. The interface module 120 includes a faceplate 180 at the mating end 134 thereof. Optionally, the faceplate 180 may be integrally formed with the housing 126, or alternatively, the faceplate 180 may be coupled to a front surface 190 of the housing 126. The housing 126 may also include a rear surface 192. The interface module 120 includes the fixed latch 140 on the side 132. The fixed latch 140 is spaced apart from the faceplate 180.

The interface module 120 is front loadable into the panel opening 104. When the interface module 120 is loaded into the patch panel 100 a rearward facing surface 181 of the faceplate 180 is configured to engage the front face 106 of the patch panel 100 and the latch 140, 141 is configured to engage a rear of the patch panel 100. When the interface module 120 is mated with the patch panel 100, the side 132 of the housing 126 is coupled to the edge of the patch panel 100 defining the panel opening 104 such that the patch panel 100 is received in the space defined between the faceplate 180 and the fixed latch 140. The interface module 120 is then pivoted such that the other side 132 of the housing 126 engages the patch panel 100. The flexible latch 141 (shown in FIG. 1) is deflected to allow the faceplate 180 to rest flush against the front face 106 of the patch panel 100. The flexible latch 141 locks behind the patch panel 100. As known to one skilled in the art, other latching mechanisms would be acceptable to lock the interface module 120 into the patch panel 100.

The modular jacks 122 are rear loaded into the jack cavities 138. In an exemplary embodiment, the modular jacks 122 are directly inserted into the jack cavities 138, such as by being loaded straight into the jack cavities 138 as opposed to being rotated or tilted into the jack cavities 138. The modular jacks 122 may be directly inserted into the interface module 120 and latched therein thereby eliminating the need to tilt the jack to engage a second latch. The jack cavities 138 include a top wall 182, a bottom wall 184 and a longitudinal axis 186 extending along the jack cavities 138. The jack latch openings 146 are provided in the top wall 182 of each of the jack cavities 138. The jack latch openings 146 are sized and shaped to hold the hook ends 168 of the latch arms 166. In an exemplary embodiment, the housing 126 includes a central wall 188 that separates the jack cavities 138 of the top row from the jack cavities 138 of the bottom row. The central wall 188 defines the top wall 182 for each of the jack cavities 138 in the bottom row and the bottom wall 184 for each of the jack cavities 138 in the top row. The bottom wall 184 of each jack cavity 138 is generally planar a flat.

The modular jacks 122 are loaded into the jack cavities 138 such that the hook end 168 of the latch arm 166 is received within the corresponding jack latch opening 146. During loading, the latch arms 166 are flexed as the modular jacks 122 are inserted until the hook ends 168 are released into jack latch openings 146. The modular jacks 122 are loaded into the jack cavities 138 such that the bottom surface 158 of each modular jack 122 rests on the bottom wall 184 of the corresponding jack cavity 138. During loading, the modular jacks 122 are loaded in a linear direction that is generally parallel to the longitudinal axis 186 of the jack cavity 138. During loading, the bottom surface 158 slides along, and is guided into the jack cavity 138 by, the bottom wall 184.

In an exemplary embodiment, the modular jacks 122 are loaded into the interface module 120 prior to mating the interface module 120 with the patch panel 100. The modular jacks 122 are loaded into the jack cavities 138 in front of the patch panel 100, which may or may not be coupled to the rack. As such, the twelve modular jacks 122 along with the interface module 120 may be mated to the patch panel 100 as a sub-assembly. Similarly, when disconnecting the modular jacks 122 from the interface module 120, the interface module 120 may be removed from the patch panel 100 and pulled to the front area of the patch panel 100 where the technician can individually remove each modular jack 122 from the interface module 120. Alternatively, the interface module 120 may be mounted to the patch panel 100 and then the individual modular jacks 122 can be loaded into the jack cavities 138. Similarly, the modular jacks 122 may be removed from the jack cavities 138 while the interface module 120 remains mounted to the patch panel 100.

Figure 4:
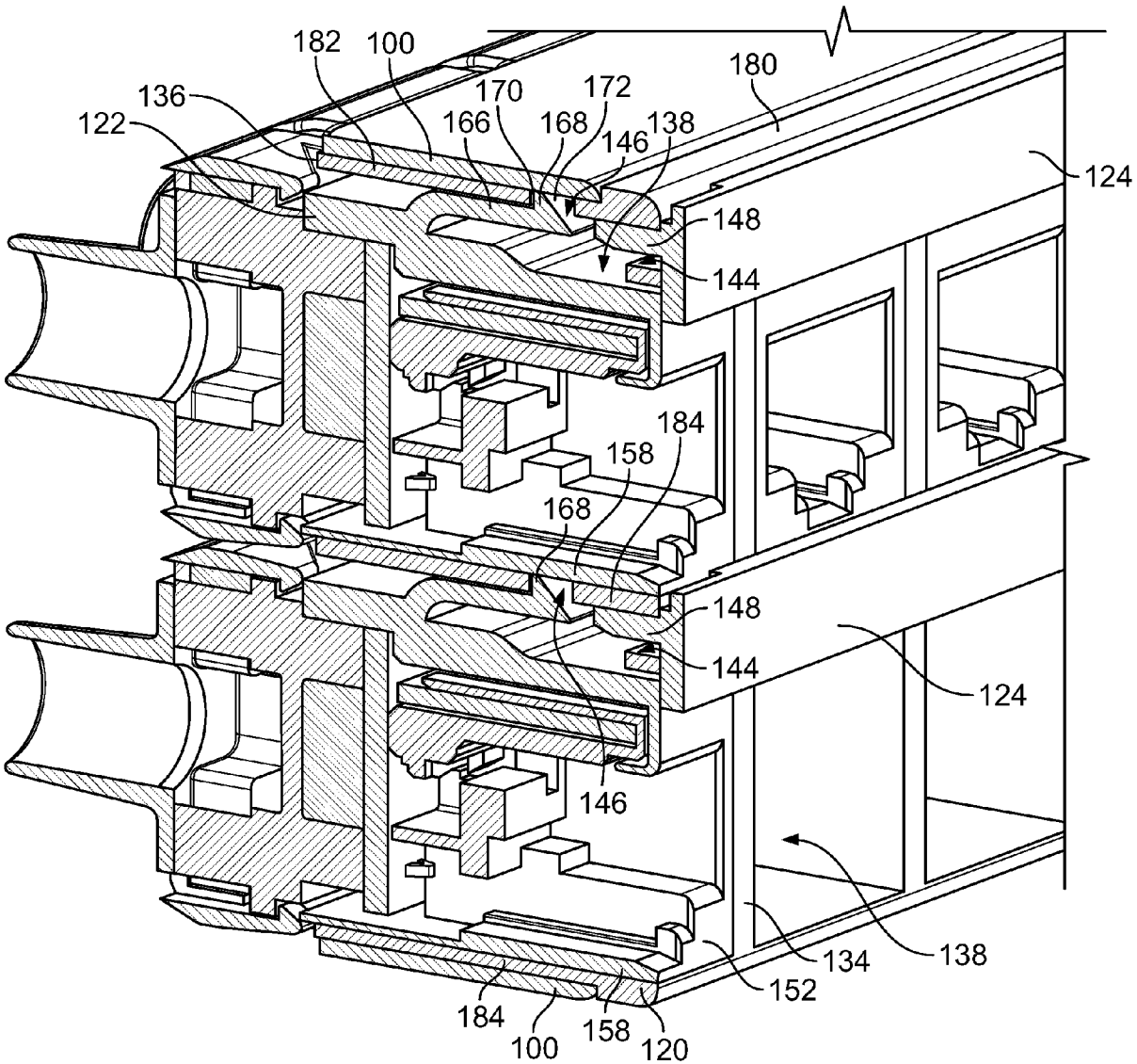
FIG. 4 is a side cut-away view of one of the interface modules with the modular jacks loaded therein and the interface module loaded into the patch panel.

FIG. 4 is a side cut-away view of one of the interface modules 120 mated to the patch panel 100 with the modular jacks 122 loaded into the jack cavities 138. The panel labels 124 are illustrated attached to the faceplate 180, with one panel label 124 on top of the top row of modular jacks 122 and another panel label 124 on top of the bottom row of modular jacks 122. More particularly, the attachment features 148 are loaded into the secondary openings 144 to retain the panel labels 124 to the interface module 120.

FIG. 4 also illustrates the modular jacks 122 loaded into the jack cavities 138. The mating ends 152 of the modular jacks 122 are generally flush with the mating end 134 of the interface module 120. The bottom surface 158 of each modular jack 122 rests on the bottom wall 184 of the corresponding jack cavity 138. The hook end 168 of the latch arm 166 is received within the corresponding jack latch opening 146 in the top wall 182 of each jack cavity 138. As shown in FIG. 4, the top of the hook end 168 does not protrude from the jack latch opening 146 so that the bottom surface 158 of the modular jack 122 inserted in the upper row may rest flush with the bottom wall 184 of the jack cavity 138. The catch surface 170 engages the rear edge defining the jack latch opening 146. The ramp surface 172 is positioned within the jack latch opening 146 and is generally forward facing.

In an exemplary embodiment, to remove the modular jack 122 from the jack cavity 138, the latch arm 166 is pressed downward until the catch surface 170 clears the jack latch opening 146. To depress the latch arm 166, with the panel label 124 removed, a tool is inserted into the secondary opening 144 and pushed downward and rearward, such as in a direction toward the loading end 136. As the tool engages the ramp surface 172, the latch arm 166 is pressed downward and out of the jack latch opening 146. The tool presses on the ramp surface 172 to flex the latch arm 166 so that the catch surface 170 disengages from the jack latch opening 146. The modular jack 122 may then be removed from the interface module 120.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A module assembly comprising an interface module adapted for front loading into a patch panel including:

a housing having at least one jack cavity configured to receive a modular jack therein, the modular jack including a first surface and an opposite second surface, the modular jack having a deflectable latch arm extending from the first surface, the second surface being planar, the housing having a faceplate on a front surface thereof, wherein the faceplate includes a rearward facing surface;

at least one jack latch opening configured to receive the latch arm of the modular jack; and a latch mechanism on the housing for latching the module into the panel, the latch mechanism including a fixed latch extending outward from one side of the housing and a flexible latch extending outward from an opposite side of the housing, the flexible latch being movable between a latched position and an unlatched position to lock and unlock the housing to the patch panel, wherein when the housing is loaded into the patch panel the rearward facing surface of the faceplate is configured to engage a front of the patch panel and the latch mechanism is configured to engage a rear of the patch panel.

2. The module assembly of claim 1, wherein the jack cavities are configured to receive the modular jacks either prior to or after the housing is mated with the patch panel.

3. The module assembly of claim 1, wherein the faceplate is integrally formed with the housing.

4. The module assembly of claim 1, wherein the latch mechanism is releasably latched to the patch panel such that the housing is configured to be pulled from the front of the patch panel when the latch mechanism is released.

5. The module assembly of claim 1, wherein the at least one jack cavity comprises a plurality of jack cavities arranged in an upper row and a lower row, the latch arms of the modular jacks received in the lower row of jack cavities engaging the planar second surface of the modular jacks received in the upper row of jack cavities.

6. A module assembly comprising an interface module including:

a housing having a planar front surface, a rear surface and a plurality of jack cavities extending along a longitudinal axis perpendicular to the planar front surface, the housing having walls defining the jack cavities and the jack cavities are configured to receive modular jacks therein, wherein each modular jack includes a first surface and an opposite second surface, the modular jack having a deflectable latch arm with a hook end extending from the first surface, the second surface being planar;

a plurality of primary openings in the front surface providing access to the jack cavities;

jack latch openings in corresponding walls of each jack cavity, the jack latch openings being positioned remote from the front surface, the jack latch openings being configured to receive the hook end of the latch arm of the modular jack received within the jack cavity;

a plurality of secondary openings open through the front surface, each secondary opening being aligned with a corresponding primary opening and being aligned with a corresponding jack latch opening, the secondary openings being configured to receive a tool through the front surface for engaging and releasing the hook end of the modular jack from the jack latch opening; and a label plate having at least one attachment feature, wherein the secondary openings are configured to receive the at least one attachment feature such that the label plate is aligned with at least one of the primary openings.

7. The module assembly of claim 6, wherein the secondary openings are substantially horizontally aligned with the primary openings and substantially vertically aligned with the jack latch openings.

8. The module assembly of claim 6, wherein the hook end of the latch arm includes a catch surface and a ramp surface, the jack cavity is configured to receive the modular jack such that the jack latch opening catches the catch surface and the ramp surface generally faces the secondary opening such that the tool engages and presses the ramp surface generally out of the jack latch opening as the tool is inserted into the secondary opening.

9. The module assembly of claim 6, wherein the label plate extends across the front surface along a plurality of the primary openings.

10. The module assembly of claim 6, wherein an equal number of primary openings, jack latch openings, and secondary openings are provided in the housing.

11. The module assembly of claim 6, wherein the jack cavities are arranged in an upper row and a lower row, the latch arms of the modular jacks received in the lower row of jack cavities engaging the planar second surface of the modular jacks received in the upper row of jack cavities.

12. The modular assembly of claim 6, wherein the housing is adapted for loading into a patch panel, the patch panel having a planar panel body having an opening that receives the housing, the planar front surface of the housing being oriented parallel to the planar panel body of the patch panel.

13. A module assembly comprising:

an interface module including a housing having a plurality of jack cavities and associated jack latch openings, the jack cavities are arranged in an upper row and a lower row, the housing being configured to be mated with a patch panel; and a plurality of modular jacks being directly inserted into corresponding jack cavities, each modular jack including a first surface and an opposite second surface, each modular jack having a single latch arm extending from the first surface that engages the jack latch opening to retain the modular jack in the jack cavity, the second surface being planar, the latch arms of the modular jacks received in the lower row of jack cavities engaging the planar second surface of the modular jacks received in the upper row of jack cavities.

14. The module assembly of claim 13, wherein each jack cavity includes a top wall having the jack latch opening and a bottom wall, the second surface defining the bottom-most portion of the modular jack, the second surface resting flush with the bottom wall.

15. The module assembly of claim 13, wherein the modular jacks are inserted into the jack cavities either prior to or after the housing is mated with the patch panel.

16. The module assembly of claim 13, wherein the housing has a mating end and a loading end and wherein the cavities have a longitudinal axis extending between the mating and loading ends, the modular jacks having a central axis, each modular jack being insertable into the corresponding jack cavity in a direction parallel to the longitudinal axis such that the central axis remains coincident with the longitudinal axis as the modular jack is inserted into the jack cavity.

17. The module assembly of claim 13, wherein the jack cavities are arranged in two vertically staged rows, the interface module being configured to fit into a 1 U height requirement of the patch panel.

18. The module assembly of claim 13, wherein the jack cavities are arranged in an upper row and a lower row that are separated by a wall of the housing, the wall defining a top wall of the jack cavities in the lower row and a bottom wall of the jack cavities in the upper row, the wall having a plurality of the jack latch openings, wherein the latch arms are sized to fit within the jack latch openings so that the modular jacks in the upper row rest flush with the wall of the housing.

19. The module assembly of claim 13, wherein the modular jacks do not include a latch extending from the second surface such that the modular jack is insertable into the corresponding jack cavity in a linear direction.

* * * * *